United States Patent [19]

Klein

[11] 4,397,143

[45] Aug. 9, 1983

[54] LUBRICATING SYSTEM FOR ANTI-BALLOONING RINGS OF TEXTILE MACHINES

[75] Inventor: Konrad Klein, Ebersbach-Sulpach, Fed. Rep. of Germany

[73] Assignee: Zinser Textilmaschinen GmbH, Ebersbach, Fed. Rep. of Germany

[21] Appl. No.: 321,072

[22] Filed: Nov. 13, 1981

[30] Foreign Application Priority Data

Nov. 15, 1980 [DE] Fed. Rep. of Germany ..... 3043214

[51] Int. Cl.[3] ..... D01H 13/12; D01H 13/04; D01H 7/62

[52] U.S. Cl. ..... 57/355; 57/120

[58] Field of Search ..... 57/354–357, 57/119, 120

[56] References Cited

U.S. PATENT DOCUMENTS

| | | | |
|---|---|---|---|
| 2,791,880 | 5/1957 | Raboisson | 57/120 |
| 2,830,433 | 4/1958 | Raboisson | 57/120 |
| 3,638,415 | 2/1972 | Andrews | 57/355 |

*Primary Examiner*—John Petrakes

*Attorney, Agent, or Firm*—Karl F. Ross

[57] ABSTRACT

An anti-ballooning ring confining an orbiting yarn in spinning or twisting machinery has an inner surface divided into a convex lower annular contact zone, hugged by the descending yarn body, and a concave upper annular zone or groove diverging from the path of the yarn so as to be swept only by radially outwardly protruding fiber ends. A wick, dipping into a supply of lubricant remote from the ring, traverses a ring-supporting tube and has an exposed stretch lodged in the groove for engagement by such protruding fiber ends which pick up lubricant therefrom and carry it onto the convex contact zone.

7 Claims, 4 Drawing Figures

LUBRICATING SYSTEM FOR ANTI-BALLOONING RINGS OF TEXTILE MACHINES

FIELD OF THE INVENTION

My present invention relates to a system for lubricating anti-ballooning rings of textile machinery, namely ring spinners and twisters.

BACKGROUND OF THE INVENTION

The purpose of lubricating the contact surfaces of an anti-ballooning ring is to reduce the friction of the body of a yarn restrained by that ring, thereby making the yarn tension more uniform and, in the case of yarns composed of thermoplastic fibers, also preventing overheating thereof. The term "body of the yarn" is meant to refer to the core of twisted fibers from which individual fiber ends stand out laterally. When only these protruding fiber ends come into contact with the lubricant emerging from one or more outlets on the ring, satisfactory metering of the lubricant can be achieved without any additional measures to insure adequate lubrication of the contact surfaces. The lubricant is preferably a synthetic or, possibly, a natural oil but may also be some other fluid substance.

The anti-ballooning ring serves to restrict the radial excursion of a yarn which is entrained by a rotating spindle coaxial with that ring and passes through a traveler revolving on a spinning or twisting ring encircling the spindle.

Lubricated anti-ballooning rings are known from U.S. Pat. No. 3,638,415 and German laid-open specification No. 2,409,146, for example. In these known devices, the lubricant channels terminate at the contact surfaces against which the rotating yarns are pressed by the centrifugal forces acting on them. If, as in the apparatus according to FIG. 5 of the U.S. patent referred to, the lubricant outlet is formed by an end of a cylindrical bore of very small diameter, arranged halfway up on the contact surface, the upper half of that surface is not lubricated since the downward-traveling yarn conveys the lubricant only to the lower half thereof. Moreover, during any shutdown of the machine, lubricant may flow out from the supply channels onto the contact surfaces and, when the machine is started up again, this may cause excessive lubrication of the yarns, which is undesirable. At other times there is also a danger of excessive lubrication, since the flow of lubricant through the bore cannot be accurately controlled. If an attempt is made to avoid such excessive lubrication by the expedient of making the diameter of the bore extremely small, there is a danger that this bore will become obstructed during operation and then no lubricant at all will come out. In any case, such fine bores are expensive to produce.

As described with reference to FIG. 4 of that U.S. patent, the anti-ballooning ring can be made of sintered metal with lubricant constantly supplied to it from outside. To ensure that sufficient lubricant reaches the contact surface, however, the sintered metal must be relatively large-pored; this means that the areas located outside the contact surface have to be sealed. Lubrication is also uneven and depends to a great extent on the viscosity of the lubricant.

OBJECT OF THE INVENTION

The object of my present invention is therefore to provide, in a machine of the type described, means for properly lubricating the anti-ballooning rings which can be made of nonporous materials, more particularly solid metal, with avoidance of significant increases in manufacturing costs yet with elimination of the drawbacks referred to.

SUMMARY OF THE INVENTION

I realize this object, in accordance with my present invention, by dividing the inner surface of an anti-ballooning ring into a lower annular contact zone, having a convex curvature in an axial plane, and a radially recessed upper zone which preferably is an annular groove with a concave curvature in that plane. A supply of liquid lubricant (referred to hereinafter as oil) is connected via conduit means to an outlet disposed on the upper zone at a location which is set back from the path of a descending yarn body hugging the contact zone but is swept by fiber ends protruding radially outward from that body whereby oil picked up by these fiber ends is conveyed to the contact zone. Very thin films of oil are thus formed on the contact zone, causing virtually no soiling of the yarn; consequently, at least in many instances, there is no need for subsequent removal of the extremely small quantities of oil adhering to the yarn. Moreover, the oil does not cause any problems each time the machine is started up, since none of it is conveyed to the contact zone of any anti-ballooning ring during the periods of shutdown and the extremely thin oil films present on the inner ring surfaces when the machine is turned off remain unaffected during the periods of standstill. The means provided by my invention for lubricating the anti-ballooning rings are simple and inexpensive; the anti-ballooning rings can be produced cheaply since they do not require any complicated arrangements for lubrication. Furthermore, the amount of oil used is very small and this reduces the costs of lubrication. This mode of lubrication of the contact surfaces of the anti-ballooning rings is also reliable in operation and favorable from the maintenance point of view. The parts of the anti-ballooning rings forming the contact zones may be made of nonporous solid metal; this fact, along with the lubrication of the contact zones, means that there is virtually no wear so that the anti-ballooning rings may have a very long service life.

The position of the oil outlet or outlets on the inner surface of the anti-ballooning ring should, of course, be such that the number of fiber ends sweeping these outlets is sufficient for lubrication of the contact zone.

The oil is preferably supplied to any outlet by means of a wick forming part of the aforementioned conduit means. Advantageously, each outlet includes two bores arranged side by side with a small peripheral spacing from each other, these bores opening onto the upper zone of the inner surface of the anti-ballooning ring. In that case the wick is threaded through the bores in such a way that an exposed portion thereof emerges from the ring via one bore and re-enters the ring through the other bore whereby that exposed portion spans and bridges the gap between these two bores.

In many cases the wick could be omitted, particularly if the oil has a relatively high viscosity which would impede its flow to the outlet with the required degree of continuity if a wick were provided.

According to another advantageous feature of my invention, a radial holder supporting the anti-ballooning ring on the frame of the machine may be tubular and form part of a lubricant channel connecting the outlet with an oil reservoir on the frame. In such a machine several—e.g 5 to 20—anti-ballooning rings can be served by a single oil reservoir connected to the outlets of all these rings by way of their tubular supports. It is particularly useful to place at least one absorbent insert, preferably designed as a strip of felt, in the reservoir for the purpose of soaking up the oil and to rest an extremity of each wick on this insert in order to pick up the lubricant.

BRIEF DESCRIPTION OF THE DRAWING

The above and other features of my invention will now be described in detail with reference to the accompanying drawing in which.

SPECIFIC DESCRIPTION

Figure 1:
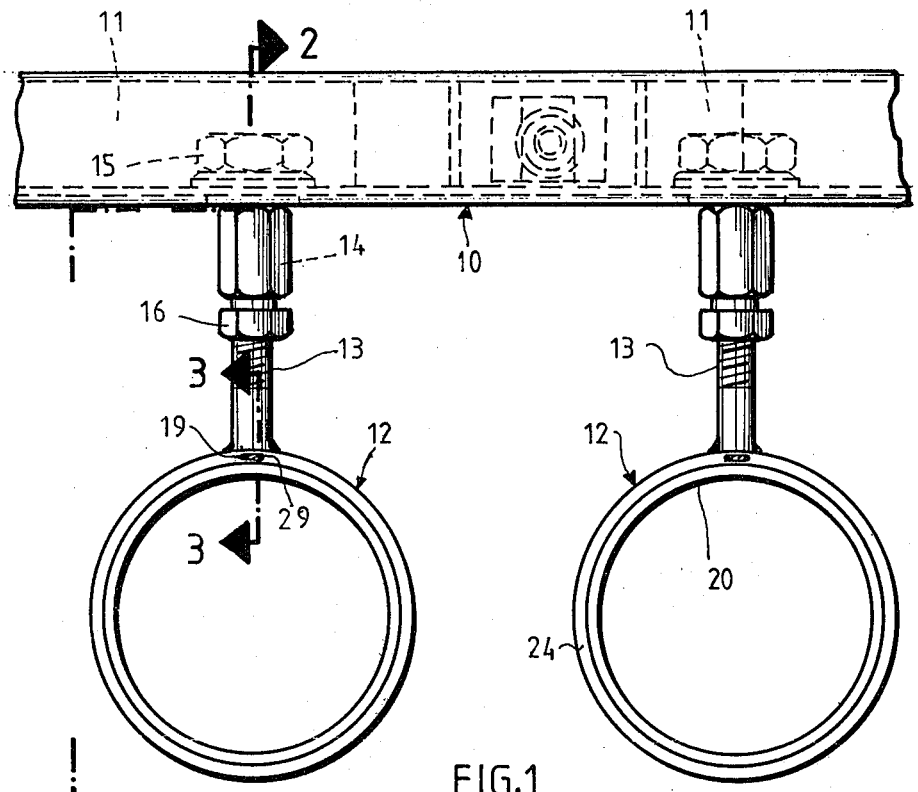
FIG. 1 is a partial plan view of a frame of a ring spinner or twister supporting several anti-ballooning rings.
Figure 2:
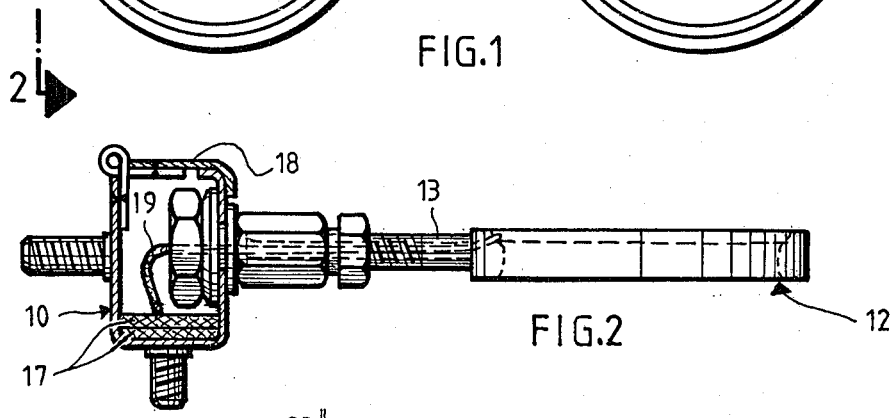
FIG. 2 is a partly sectional view of the assembly of FIG. 1, taken along the line 2—2 thereof.

FIG. 1 shows part of a frame 10 supporting a number of anti-ballooning rings 12 of identical construction (two of them visible in plan view) and containing a number of lubricant reservoirs 11 disposed along one side of an otherwise nonillustrated ring spinner or twister. Each reservoir 11 may be associated, for example, with five to twenty anti-ballooning rings 12 for the lubrication thereof. Each anti-ballooning ring 12 is secured to frame 10 by a horizontal support tube 13 which is welded to the outside of the ring 12. The support tube 13 has an external thread and partly projects through a front opening into the reservoir 11; the latter can be closed by means of a lid 18 and is fixed to the frame 10 by means of two nuts 14, 15 which can be secured against loosening by means of a locknut 16. The nuts 14, 15 also permit axial adjustment of the tube 13. Disposed on the base of each reservoir 11 are two strips of felt 17 arranged one above the other and soaked in oil; for each anti-ballooning ring 12 both ends of a wick 19, passing through the corresponding support tube 13 to the ring 12 and back, rest on these felt strips 17, the wick 19 serving to lubricate a contact zone 20 on the inner surface of the ring which is slightly convex in cross-section. The body 23' of a yarn 23, restrained by the anti-ballooning ring 12 while orbiting about its axis, is pressed against contact zone 20 by the centrifugal force acting on it in the direction of arrow A (FIG. 3).

Figure 3:
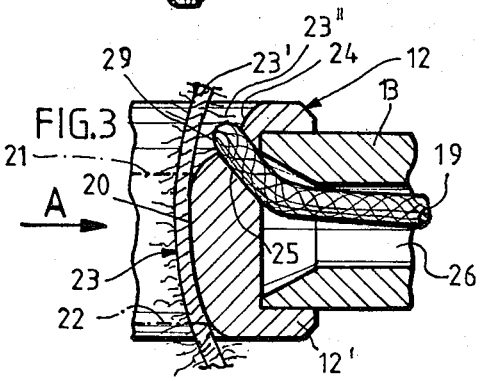
FIG. 3 is a fragmentary sectional view of the assembly, drawn to a larger scale and taken along the line 3—3 of FIG. 1.
Figure 4:
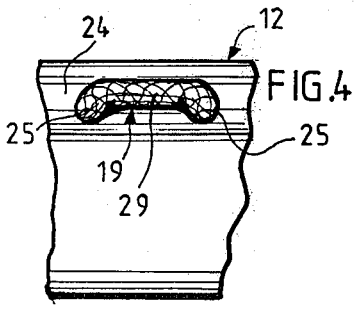
FIG. 4 is an enlarged, cut-away view of the inner surface of an anti-ballooning ring provided with a lubricant outlet as seen in the direction of an arrow A of FIG. 3.

As seen in FIG. 3, contact zone 20 extends between upper and lower boundaries respectively indicated by phantom lines 21 and 22. Above zone 20, which is centered on the axis of the anti-ballooning ring 12, there is a groove 24 which is also centered on that axis and which constantly increases in diameter in the upward direction so that, during operation, the yarn body 23' cannot lie against it but only fiber ends 23" projecting radially outward from the yarn 23 can reach it. The solid annular body 12' of the anti-ballooning ring 12, made of nonporous metal, has two bores 25 leading into a central channel 26 of the support tube 13 and opening onto the surface of the groove 24, about halfway up from zone boundary 21, while being separated from each other in the circumferential direction of the groove 24 by a small spacing. The wick 19 leads from reservoir 11 through the channel 26 of tube 13 and through one bore 25 into the groove 24 and returns to that reservoir through the other bore 25 and channel 26. The two extremities of the wick thus rest in the reservoir 11 on the oil-soaked felt insert 17.

The two bores 25 may have diameters of about 1 mm, for example.

The short, exposed wick portion 29 lying between outlet bores 25 is swept by fiber ends 23" protruding from the yarn 23 but does not make contact with the yarn body 23', as is clear from FIG. 3. As the protruding fiber ends 23" pick up some of the oil, they transfer it to the contact zone 20 as the yarn 23 moves down; this contact zone 20 is satisfactorily and evenly lubricated, with only a minimum consumption of oil.

I claim:

1. In a textile machine wherein a yarn orbiting about an upright axis descends within an anti-ballooning ring restricting radial excursions of the yarn, the combination with said ring of a supply of liquid lubricant and conduit means extending from said supply to an outlet at an inner surface of said ring, said inner surface being divided into a lower annular contact zone of convex curvature in an axial plane and a radially recessed upper zone, said outlet being disposed in said upper zone at a location set back from the path of a yarn body hugging said contact zone but swept by fiber ends protruding radially outward from said yarn body whereby lubricant picked up by said fiber ends is conveyed to said contact zone.

2. The combination defined in claim 1 wherein said upper zone is an annular groove of concave curvature in an axial plane.

3. The combination defined in claim 1 or 2 wherein said conduit means includes a radially extending tube supporting said ring on a frame of the machine, said tube forming part of a channel connecting said supply with said outlet.

4. The combination defined in claim 3 wherein said supply comprises a reservoir on said frame, said conduit means further including a wick dipping into said reservoir and traversing said channel with an exposed portion lying on said upper zone.

5. The combination defined in claim 4 wherein said outlet includes two peripherally spaced-apart bores opening onto said upper zone, said exposed portion emerging from said ring via one of said bores and reentering said ring through the other of said bores.

6. The combination defined in claim 4, further comprising an absorbent insert in said reservoir soaked with lubricant, said wick having an extremity resting on said insert.

7. The combination defined in claim 6 wherein said insert is a felt strip.

* * * * *